US006742219B2

(12) United States Patent
Lenzmeier et al.

(10) Patent No.: US 6,742,219 B2
(45) Date of Patent: Jun. 1, 2004

(54) AIR SWEEPING APPARATUS

(75) Inventors: Michael H. Lenzmeier, North Branch, MN (US); Larry D. Wydra, Plymouth, MN (US)

(73) Assignee: Tennant Company, Minneapolis, MN (US)

( * ) Notice: Subject to any disclaimer, the term of this patent is extended or adjusted under 35 U.S.C. 154(b) by 220 days.

(21) Appl. No.: 10/046,589

(22) Filed: Oct. 29, 2001

(65) Prior Publication Data

US 2003/0079310 A1 May 1, 2003

(51) Int. Cl.[7] ..... E01H 1/08
(52) U.S. Cl. ..... 15/345; 15/340.1; 15/347
(58) Field of Search ..... 15/340.1, 340.2, 15/340.3, 340.4, 347, 345

(56) References Cited

U.S. PATENT DOCUMENTS

| | | | | |
|---|---|---|---|---|
| 3,221,358 A | * | 12/1965 | Dickson | 15/345 |
| 3,512,206 A | | 5/1970 | Young | |
| 3,938,217 A | | 2/1976 | Hommes | 15/346 |
| 4,006,511 A | | 2/1977 | Larsen | |
| 4,007,026 A | | 2/1977 | Groh | |
| 4,044,422 A | | 8/1977 | Larsen | |
| 4,099,290 A | | 7/1978 | Hiszpanski | |
| 4,109,341 A | | 8/1978 | Larsen et al. | |
| 4,110,864 A | | 9/1978 | Gunnarsson | |
| 4,359,801 A | * | 11/1982 | Tate | 15/346 |
| 4,450,601 A | | 5/1984 | Shwayder | |
| 4,457,043 A | * | 7/1984 | Oeberg et al. | 15/346 |
| 4,464,810 A | * | 8/1984 | Karpanty | 15/320 |
| 4,466,156 A | | 8/1984 | Blehert | 15/346 |
| 4,525,888 A | | 7/1985 | Bargiel et al. | |
| 4,557,010 A | | 12/1985 | Rosseau | |

(List continued on next page.)

FOREIGN PATENT DOCUMENTS

| | | | |
|---|---|---|---|
| DE | 3316952 A1 | * | 11/1984 |
| FR | 94 15995 | | 7/1996 |
| GB | 2360310 | | 9/2001 |
| RU | 2025555 C1 | * | 12/1994 |
| RU | 2029817 C1 | * | 2/1995 |

OTHER PUBLICATIONS

International Search Report (PCT/US02/34705), dated Jan. 30, 2003.

*Primary Examiner*—Terrence R. Till
(74) *Attorney, Agent, or Firm*—Fulbright & Jaworski L.L.P.

(57) ABSTRACT

An air sweeping apparatus having a head assembly, a debris conveyer and a receptacle. The head assembly includes a front skirt which is selectively positionable away from a surface to be cleaned to enable debris of different densities and sizes to be collected. After the front skirting of the head assembly is moved past debris, the debris becomes entrained within a flow of air formed by a line of pressurized air as it traverses the surface and the interior surface of the main chamber of the head assembly. Preferably the air flow in the head assembly is skewed with respect to the direction of travel to urge the entrained debris towards an output end of the main chamber. When debris reaches the output end of the main chamber it is transported to a debris receptacle by a low pressure conduit which discharges entrained debris into a first hopper or bin. As the debris enters the first hopper, the heavier material settles and lighter, entrained material is directed through a filter element and onto a second hopper or bin. The second hopper includes a separator which is used to remove light particulate matter. After emerging from the separator, the air stream enters an air handling device (typically a motorized fan surrounded by a shroud) where it is pressurized and directed to the input portion of the head assembly. A portion of this high pressure air flow is directed back towards a third hopper or bin in the receptacle where it is passed through a filter to remove fine particulate matter and exhausted.

46 Claims, 9 Drawing Sheets

U.S. PATENT DOCUMENTS

| | | | | | |
|---|---|---|---|---|---|
| 4,570,287 | A | | 2/1986 | Kerschner et al. | 15/346 |
| 4,660,248 | A | | 4/1987 | Young | |
| 4,773,121 | A | | 9/1988 | Young | |
| 4,807,327 | A | | 2/1989 | Jajko et al. | |
| 4,885,817 | A | * | 12/1989 | Tanase | 15/340.1 |
| 4,951,347 | A | | 8/1990 | Star et al. | |
| 5,394,586 | A | | 3/1995 | Holley | |
| 5,542,148 | A | | 8/1996 | Young | |
| 5,794,304 | A | | 8/1998 | Ritter | |
| 5,852,847 | A | | 12/1998 | Weiss et al. | |
| 5,996,171 | A | * | 12/1999 | Bowers | 15/340.1 |
| 6,161,250 | A | * | 12/2000 | Young et al. | 15/346 |
| 6,502,277 | B1 | | 1/2003 | Petersson et al. | 15/352 |

* cited by examiner

AIR SWEEPING APPARATUS

BACKGROUND OF THE INVENTION

1. Field of the Invention

The present invention relates to a surface cleaning apparatus and more particularly to an air sweeping apparatus.

2. Description of the Prior Art

Recirculating air systems have been in use for many years and are preferred over vacuum based systems for sweeping large areas. They generally comprise an air stream that is constrained to move along an air circulation loop. The air stream is pressurized, directed onto a surface to entrain debris, drawn by low pressure into a suitable receptacle, filtered and then re-pressurized. In some recirculating air systems some of the air is diverted from the loop and discharged to the atmosphere. These machines may also include brooms to assist in debris removal.

There are at least three types of head assemblies commonly used on recirculating air sweepers. The first type uses a broom or brooms to mechanically sweep debris into a row where it is then drawn up by a relatively small, lower pressure suction head. The second type of head assembly is a cross flow head. This is typically a single chambered head which extends transversely to the direction of motion of the head as it moves along a surface being swept. With this head, air is blown into one end of the head, travels along the length thereof and is then drawn out the other end. The third type of head assembly is a two-chambered head. Here, air fills a first pressure chamber that is above or behind a second pick-up or sweeping chamber. Pressurized air from the first chamber is fed into a gap or nozzle that extends along the sweeping chamber of the head. As the pressurized air exits the gap, it is formed into an air curtain or sheet which is directed towards the surface being swept in a direction substantially coincident with the direction of travel. The pressurized air entrains debris in high velocity turbulent air flow and transports the debris along the sweeping chamber of the head assembly until it is drawn out of the head to a suitable receptacle by low pressure. Once the air stream/debris mixture leaves the head, it is conveyed into a hopper where the debris is separated out of the air stream and collected for later disposal. The air then continues out of the hopper to be re-pressurized after which a majority of the air stream is directed back into the head assembly and the remainder is exhausted to the atmosphere. One example of a sweeper for road or other surfaces is disclosed in U.S. Pat. No. 4,660,248, the sweeper including a pickup head, a hopper into which debris is adapted to be discharged, and a centrifugal separator for filtering the air stream. Other aspects of recirculating air sweepers are disclosed in U.S. Pat. Nos. 4,006,511, and 4,109,341.

The aforementioned recirculating air systems have their drawbacks. One drawback is that as the air stream moves along the sweeping chamber of the head and exits the head, the air stream must make a series of sharp angular turns and starts to spin into a vortex. This results in a reduction in the efficiency of the air stream to entrain and convey debris. This relative inefficiency can be overcome by providing greater air flow through the system, but this requires larger fans, motors, etc.; each of which add to the cost, power requirements, and/or weight of the system.

Another drawback with the aforementioned recirculating air system occurs at the head. Since there is high velocity turbulent air flow in the head, steps must be taken to prevent air from escaping the head while letting debris enter. This is typically achieved with front and rear skirts made from elastomeric materials. The skirting used, however, has limitations. One limitation, for example, is that a relatively pliable front skirt that is able to be deflected by light debris as it passes thereover and is not able to resist the force of air as it is drawn into the pick-up chamber. This results in the skirt being lifted away from the ground and toward the pick-up chamber creating a situation in which clouds of dust may get ejected from the head. This dusting may be reduced by providing a second skirt in front of the first skirt. However, use of such a second skirt has its drawbacks. Some of the debris which is captured between the skirts escapes at the ends, particularly when the air sweeper is cornering, to form trails. Conversely, another limitation is that a relatively stiff front skirt (one that is able to resist the force of air as it is drawn into the pick-up chamber) will not deflect when it encounters light debris. As a result, the skirt plows the lighter material in front of the head. This debris may accumulate between the skirting where it reduces overall efficiency and facilitates dusting and trailing. Yet another drawback occurs at the end wall of the pick-up chamber as it travels over an uneven surface. In operation, a localized high pressure zone is created at the end wall of the chamber. This does not present too much of a problem with relatively smooth surfaces. However, when the end wall of a pick-upchamber passes over a depression such as a pot hole, some of the air and entrained debris blows out of the chamber in yet another dust cloud.

Once debris has been entrained and transported to a suitable receptacle, the debris is usually separated from the air stream. There are several methods used to separate the debris from the air stream. One method mixes water with the dirty air stream. With this system, screens are used to separate larger debris from the mixture leaving the heavy debris to settle out of the water in a holding tank. The water is then recycled through the system. This method has its drawbacks. The water adds excess weight to the hopper and must be periodically cleaned. An additional concern is that of leakage and degradation. The hopper or bin may initially be water tight, but it may develop leaks over time. In other systems, small quantities of water are injected into the air stream to help separate dust from the air stream. This presents a problem, however, because when water is mixed with small or fine particulate matter, mud is formed. This mud clogs filters and reduces the efficiency of the air sweeper. The filters must, therefore, be periodically inspected and serviced to ensure that the air sweeper is operating within normal parameters.

Another method of separation uses the centrifugal force of debris to separate it from a cyclonic air stream. This is not without its drawbacks. One drawback is that the debris extracted from the air stream is often allowed to settle out in a main hopper. There, the debris is subject to internal air currents and may become re-entrained as the air stream swirls about the hopper. Alternatively, the extracted debris is collected in a secondary hopper internal to the main hopper. This alleviates some of the problems of re-entraining, however, the secondary hoppers are usually an afterthought. Additionally, the secondary hopper is usually provided with its own cover. Often, the secondary hoppers are not sealed and are loosely hinged. This allows dust contained therein to leak into the main hopper. Moreover, when emptying the hoppers, the secondary hopper is emptied into the main hopper as the main hopper is being dumped. This precludes continued separation of the differently sized debris and may complicate disposal.

There is a need for an air sweeper which may be adjustably configured depending upon the size and type of debris to be removed and collected from a surface. There is a need for an air sweeper with a collection chamber which is configured to suspendingly contain and transport debris in a predetermined pathway as the debris travels therealong. There is also a need for an air sweeper in which debris is separated according to size and weight, and collected in separate containers which may be accessible for emptying through a common access panel. And there is a need for an air sweeper which is able to remove and collect fine particulate matter from a surface without the assistance of liquids.

SUMMARY OF THE INVENTION

An air sweeper having a head assembly, a debris conveyer and a debris receptacle. The head assembly includes a first or main front skirt and a second front skirt which extend along the longitudinal extent of the head assembly in a generally parallel relation. The main front skirt is selectively positionable between different operational modes which enable the head assembly to collect debris of different or varying densities and sizes. In the first mode of operation, where relatively heavy debris is being collected, the main front skirt edge is in substantial contact with a surface to be cleaned as it is being drawn therealong. And, in a second mode of operation where relatively light debris is being collected, the main front skirt edge is shifted away from a surface to be cleaned as it is being drawn therealong to allow passage of the light debris thereby.

In both modes of operation, as the front skirting of the head assembly moves past debris the debris becomes entrained within a vortex formed by a sheet or curtain of pressurized air which circulates about a streamlined, curvilinear interior surface of the main chamber of the head assembly. Preferably, the streamlined interior surface of the main chamber is substantially ovate or circular in cross section along its longitudinal extent.

The interior components (ie., the main chamber, the first and second front skirts and the nozzle which produces the sheet or curtain of pressurized air) of the head assembly are skewed with respect to the direction of travel. This allows the vortex to direct debris towards an output portion or end of the main chamber. Upon reaching the output portion of the main chamber, the entrained debris exits the main chamber in a direction generally tangential to the vortex and directly into a debris conveyer which transports the debris into a debris receptacle. Generally, the output portion is contiguous with and substantially tangent to a predetermined circumferential surface of the main chamber. Preferably, the predetermined surface is a portion of or a portion adjacent to the upper edge of the main front skirt. The debris conveyor includes a low pressure conduit which operatively connects the output portion of the head assembly to the debris receptacle. Initially, the low pressure conduit discharges the entrained debris into a first hopper or bin. As the entrained debris enters the first hopper, the heavier material whose settling velocity exceeds the air velocity settles to the bottom of the hopper and the lighter, entrained material whose settling velocity is less than the air velocity is directed through a first filter element and into a second hopper or bin. The first filter element separates light debris such as paper and leaves from the air flow before it enters into the second hopper. As the air flow enters the second hopper, it is drawn into and through centrifugal separator which removes and deposits entrained light particulate matter in the second hopper. After emerging from the separator, the separator exhaust air stream enters an air handling device (typically a motorized fan surrounded by a shroud) where it is pressurized and directed to the input portion of the head assembly through a high pressure conduit. A portion of this high pressure air flow is directed via a bypass conduit towards a third hopper or bin in the debris receptacle where it is passed through a second filter element to remove fine particulate matter before it is exhausted.

The hoppers of the debris receptacle have discharge openings that are adjacent to each other and oriented so that they may be emptied at the same time by opening a common access panel and pivoting the debris receptacle about a hinge.

The main chamber of the head assembly includes an input portion and an output portion. The input portion or end of the head assembly includes one or more interior vanes to direct the pressurized air stream of the debris conveyer towards a manifold which is in communication with a nozzle. The input portion may also include a vane to direct air towards an optional bypass conduit operatively connected to the third hopper of the debris receptacle. The output end includes a barrier or inner wall which is configured to intercept entrained debris before it reaches the side at the end of the main chamber, thus minimizing trailing and dusting. As entrained debris encounters the barrier it deadheads and forms a localized high pressure zone, with the majority of the entrained debris being directed towards the output portion of the head assembly and into the debris receptacle. Fine debris which finds its way past the barrier enters a recovery chamber formed by the barrier and the side of the main chamber. The recovery chamber has a relatively lower pressure than the main chamber which allows fine particulate matter to be collected and removed to further reduce the chances of trailing or dusting. The baffle includes a stop surface which prevents the front skirt from being drawn into the output end of the head assembly when the air sweeping assembly is in the second mode of operation. Note that once the front skirt is shifted into the second mode of operation it tends to remain there due to the force of air flow being drawn into the main chamber.

The main front skirt is operatively connected to an actuator for movement between the first and second modes of operation. The actuator may be directly or indirectly connected to the front skirt so that the front skirt may be shifted away from a surface to be cleaned. The head assembly also includes side skirts which are positioned adjacent the sides of the head assembly and between the first and second front skirts. The side skirt located at the input portion of the head assembly facilitates the formation of a low pressure zone by impeding air movement directed thereagainst. This allows entrained debris which gets blown past the main front skirt to be directed back into the main chamber. The side skirt located at the output portion operates differently. Because the main front skirt has limited motion at the output portion of the head assembly, debris tends to accumulate. The side skirt located at the output portion of the head assembly directs this debris accumulation towards the center of the head assembly where it may be more readily collected.

The head assembly also includes a first rear or main skirt and a second rear skirt which also extend along the longitudinal extent of the head assembly in a generally parallel relation. The first and second rear skirts operate in a conventional manner. In order to minimize trailing and dusting, a scavenger strip is provided near the output end of the head assembly to direct fine particulate matter from a low pressure area bounded by the main rear skirt to the discharge area created at the nozzle.

Accordingly, it is an object of the present invention to provide an air sweeping system which effectively and efficiently collects and removes debris from a surface.

It is another object of the present invention to minimize debris plowing by a head assembly of an air sweeper as it moves along a surface.

Yet another object of the present invention is to increase the effectiveness of the chamber of a head assembly in transporting debris from an inlet end to an outlet end.

A feature of the present invention is the provision of a front skirt which may be selectively positioned to accommodate different types of debris.

Another feature of the present invention is that the main chamber of the head assembly is configured to foster the formation of a vortex along its longitudinal extent.

Yet another feature of the present invention is that the debris receptacle includes a plurality of hoppers which may be emptied at the same time.

An advantage of the present invention is that it does not require the use of liquids to suppress dust.

Another advantage is that filter plugging by light debris is reduced.

Yet another advantage of the present invention is that collection and dumping of debris is simplified.

These and further objects, features and advantages of the present invention will become clearer in light of the following detailed description of preferred embodiments in connection with the drawings.

DETAILED DESCRIPTION OF THE PREFERRED EMBODIMENTS

Figure 1:
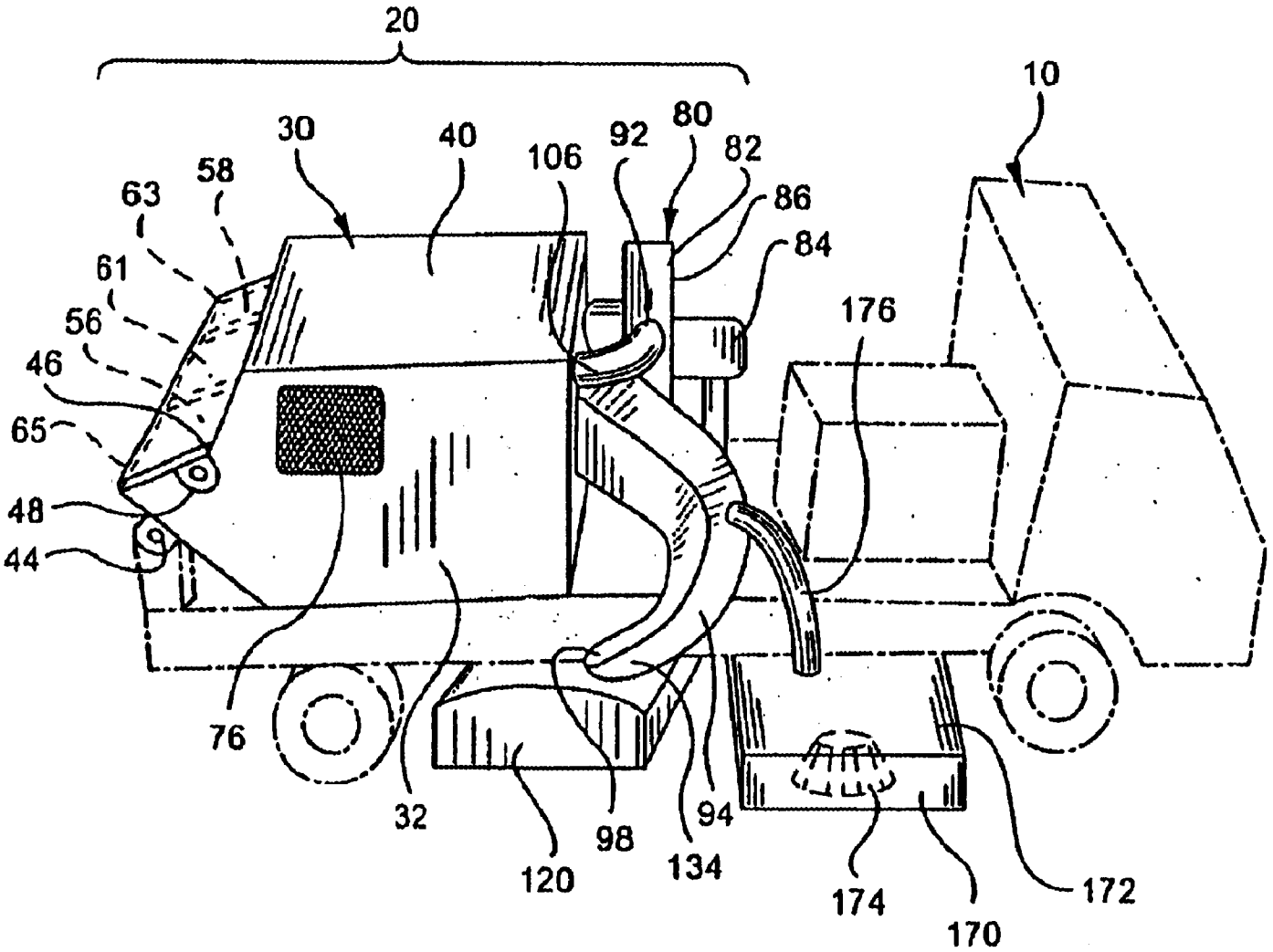
FIG. 1 is a partial perspective right side view of the air sweeper according to the present invention illustrated in connection with a utility transport vehicle depicted in phantom.
Figure 2:
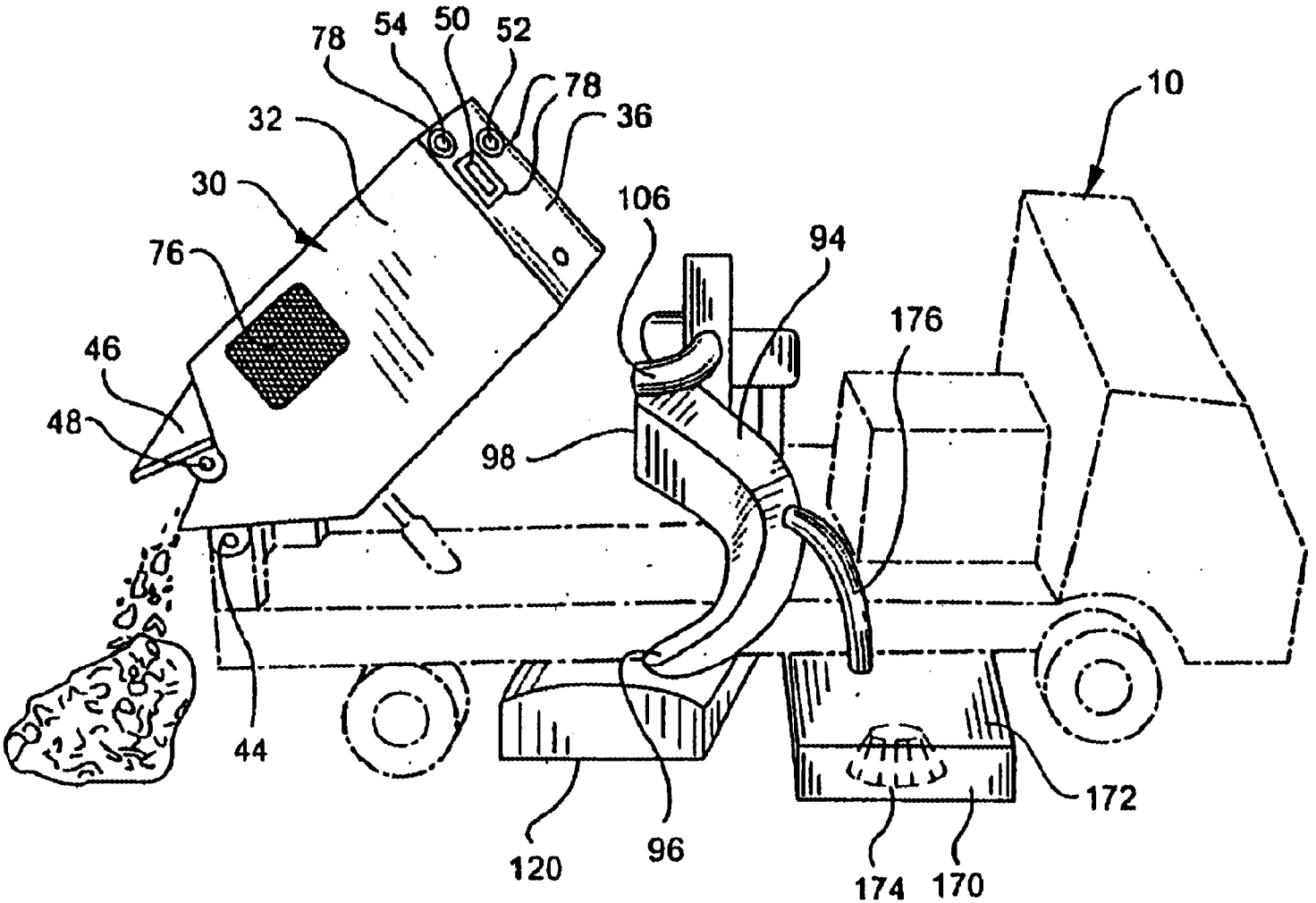
FIG. 2 is a partial perspective right side view of the air sweeper of FIG. 1 illustrating how the debris receptacle is shifted into a debris removal and disposal position.
Figure 3:
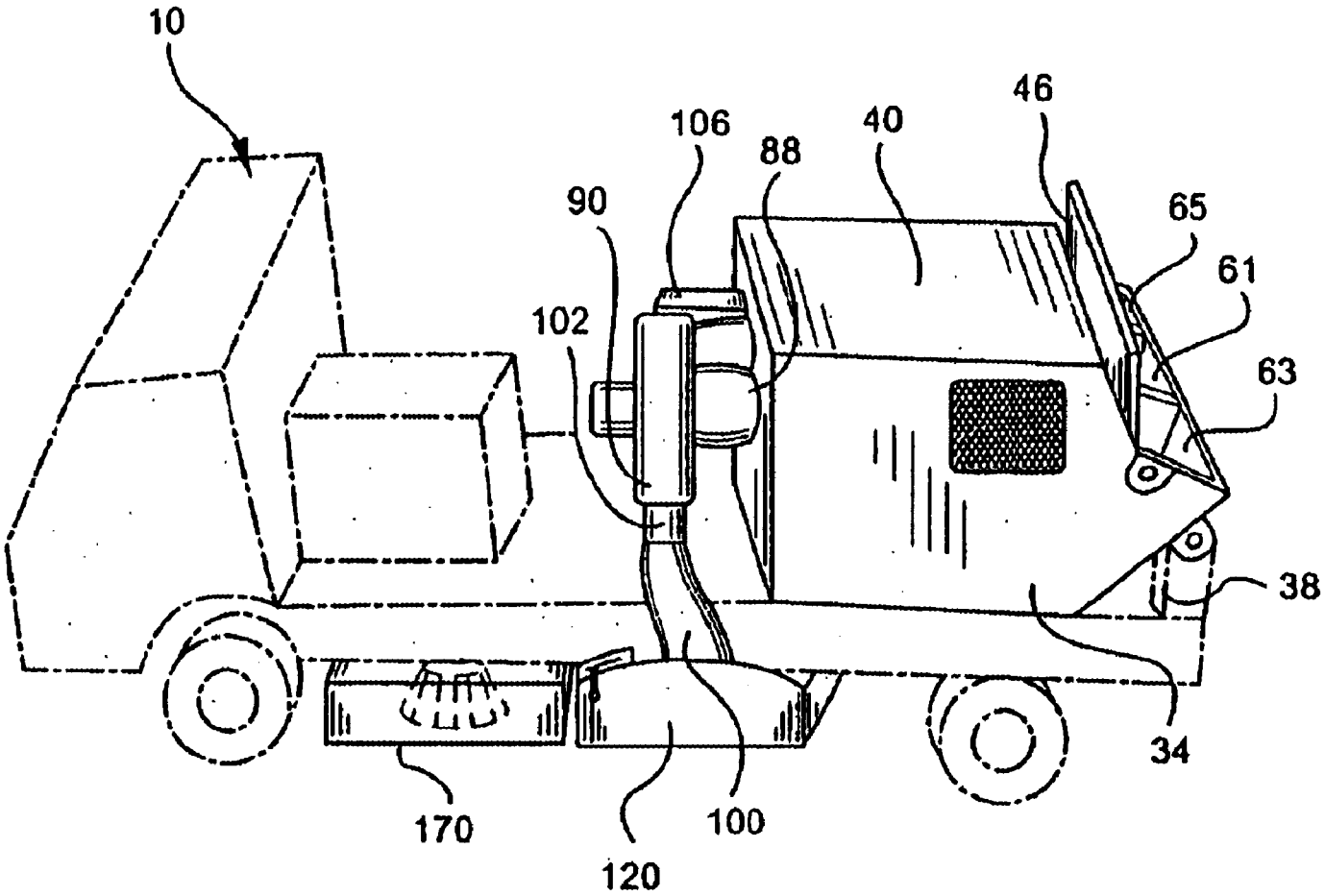
FIG. 3 is a partial perspective left side view of the air sweeper of FIG. 1.

Referring now to the drawings wherein like numerals designate like parts throughout, one preferred embodiment of the present invention is illustrated in FIGS. 1–3 as an air sweeping apparatus 20 which is movingly carried by a transport vehicle 10. The air sweeping apparatus 20 includes a debris receptacle 30, a debris conveyer 80, a head assembly 120 and a side sweeping assembly 170. The transport vehicle 10 does not form part of the invention and therefore is depicted in phantom lines. As can be seen in FIGS. 1 and 2, the head assembly 120 is skewed with respect to the direction of travel of the transport vehicle 10. This arrangement allows debris which is entrained within the main chamber of the head assembly 120 to be directed towards the output portion 134 (See, FIG. 5) and into a debris conveyer 80. Alternatively, the exterior of the head assembly 120 may take a regular rectangular shape with the internal components being skewed relative thereto.

The debris conveyer 80 includes a fan 82, motor 84 and shroud 86 common to the art having a low pressure end 88 and a high pressure end 90. As best seen in FIGS. 1 and 3, the high pressure end 90 includes an optional bypass port 92 which may be operatively connected to a bypass conduit 106 coupled to the debris receptacle 30. The debris conveyer 80 also includes a low pressure conduit 94 having a first and second ends 96, 98 and which is connected to the output portion 134 of the head assembly 120 and a debris conduit port 50 in the debris receptacle 30, respectively. Preferably, the first end 96 has a smaller cross-sectional area than the second end 98 so that the air stream and entrained debris is diffused as it travels toward the debris receptacle 30. As the diffused air stream enters the debris receptacle 30, heavier debris settles out. And, because of its relatively slower velocity, the likelihood that debris will become re-entrained is substantially reduced. Alternatively, the low pressure conduit 94 may have a relatively constant cross-sectional area along its length and the air stream diffused after it enters the debris receptacle. The side sweeping assembly 170 is of a conventional nature and includes an enclosure 172 and a sweeping element 174. The side sweeping assembly 170 also includes a conduit 176 which is operatively connected to the low pressure conduit 94.

Figure 4:
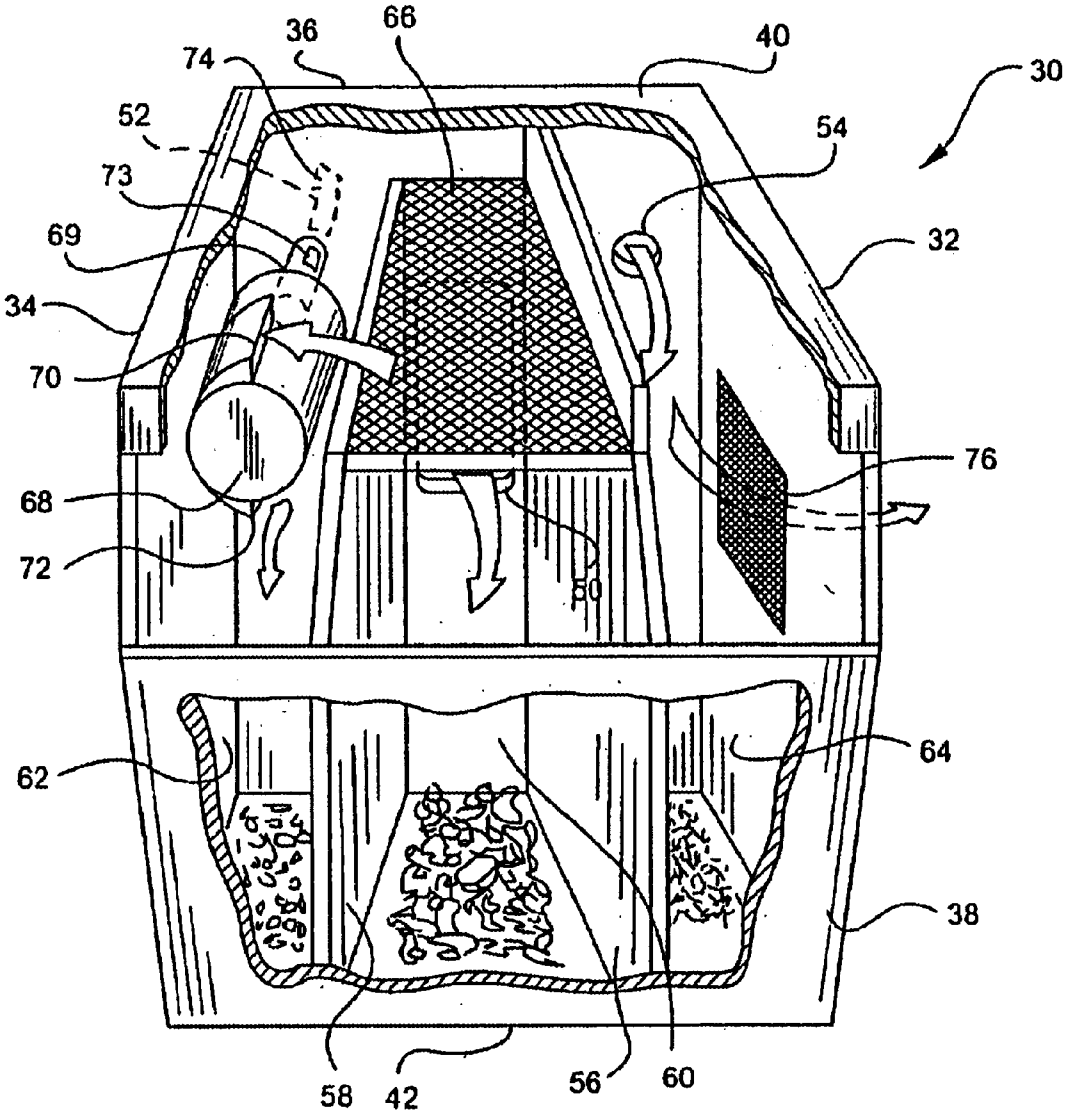
FIG. 4 is a partial perspective rear view of the debris receptacle of the present invention with the rear wall, top and access panel omitted for clarity.

Referring to FIG. 3, the debris receptacle 30 comprises a plurality of wall portions which define a substantially closed chamber, with the wall portions including a right sidewall 32, a left sidewall 34, a front wall 36, a rear wall 38, a top 40 and a bottom 42. The debris receptacle 30 also includes a movable panel 46 which is rotatably attached to the debris receptacle at a pivot point or hinge 48 and through which the interior of the debris receptacle 30 may be accessed. Preferably, the movable panel 46 extends along the width of the debris receptacle 30 in sealing contact with discharge openings 61, 63, 65 of the bins 60, 62, 64, respectively, to permit debris collected therein to be simultaneously emptied. As depicted in FIG. 2, the debris receptacle 30 is provided with a pivot point or hinge 44 which enables the debris receptacle 30 to be emptied in a conventional manner. Note, in FIG. 2 the various ports 50, 52 and 54 through which an air stream is directed. These ports correspond to hoppers or bins 60, 62 and 64 as best depicted in FIG. 4. The hoppers 60, 62 and 64 are defined by partitions 56, 58 and are sized to correspond volumetrically to the composition of debris typically collected. This feature enables the hoppers 60, 62 and 64 to be filled at roughly the same rate. The low pressure debris conduit port 50 is the port through which debris collected by the head assembly 120 passes. The low pressure port 50 is in communication with the first hopper or bin 60 in the debris receptacle 30. When the air stream and entrained debris enter the first hopper 60, the heavier material settles out. The air stream and remaining entrained debris is then directed through a first filter element 66 into the second hopper 62. The first filter element 66 is used to prevent debris larger than a first predetermined size from entering the second hopper 62. Preferably, the first filter element 66 prevents objects such as light litter and leaves from passing therethrough. After the air stream and entrained debris passes through the first filter element 66 it is drawn into a separator 68 at intake 70. The separator 68 is used to centrifugally remove light entrained debris from the air stream and deposit the material in the second hopper 62 at discharge 72. The separator 68 includes an extension 69 which is interposed between the separator 68 and the end wall 36, with one end of the extension 69 having an exhaust portion 74. The extension 69 includes an aperture 73 which enhances the efficiency of the separator 68 and helps to pull light entrained debris from the discharge 72 by lowering the pressure in the chamber 62.

The separated air stream is then directed through the exhaust portion 74 of the extension 69 to an exhaust port 52 and onto the low pressure end 88 of the debris conveyer 80. There, the air stream is pressurized by the fan 82 and exits the high pressure end 90 of the debris conveyer 80 into a high pressure conduit 100 (having first and second ends 102, 104, respectively) which is operatively connected to an input portion 132 of the head assembly 120. A portion of this high pressure air stream is drawn off at outlet 92 and directed via a bypass conduit 106 towards the bypass port 54 in the debris receptacle 30 (See, FIGS. 1–3). This portion of the air stream contains a portion of the particulate matter which has passed through the first filter element 66 and the separator 68. After this air stream passes through the bypass port 54 and into the third hopper 64 it is directed through a second filter element 76 and discharged into the atmosphere. Preferably, the second filter element 76 is positioned in one of the sidewalls of the debris receptacle 30. However, it is understood that it may be located at other locations. Alternative bypass conduits (not shown) may also be practicable for coupling between the high pressure end 90 and the third hopper 64, e.g. a conduit coupled proximate the main debris pick-up head 120 and the third hopper 64. Note that the arrangement of the hoppers 60, 62 and 64 facilitates the disposal operation. That is, the hoppers 60, 62 and 64 have discharge openings 61, 63 and 65 which are in a substantially coplanar and serial relation. This allows the movable panel 46 to be in sealing contact with the hoppers 60, 62 and 64. When the hoppers are filled with debris, it is a simple matter of pivoting the movable panel 46 from its closed position while pivoting the debris receptacle 30 backwardly about pivot point 44. Although one movable panel 46 is shown, it is understood that multiple panels may be used.

As the debris receptacle 30 is pivoted for debris disposal, the ports 50, 52 and 54 are brought out of contact with the debris conveyer 80 of the air sweeping apparatus 20 remains stationary. In order to reduce inflow or outflow of air between the junctions of the ports and the debris conveyer, sealing material 78 may be provided.

Figure 5:
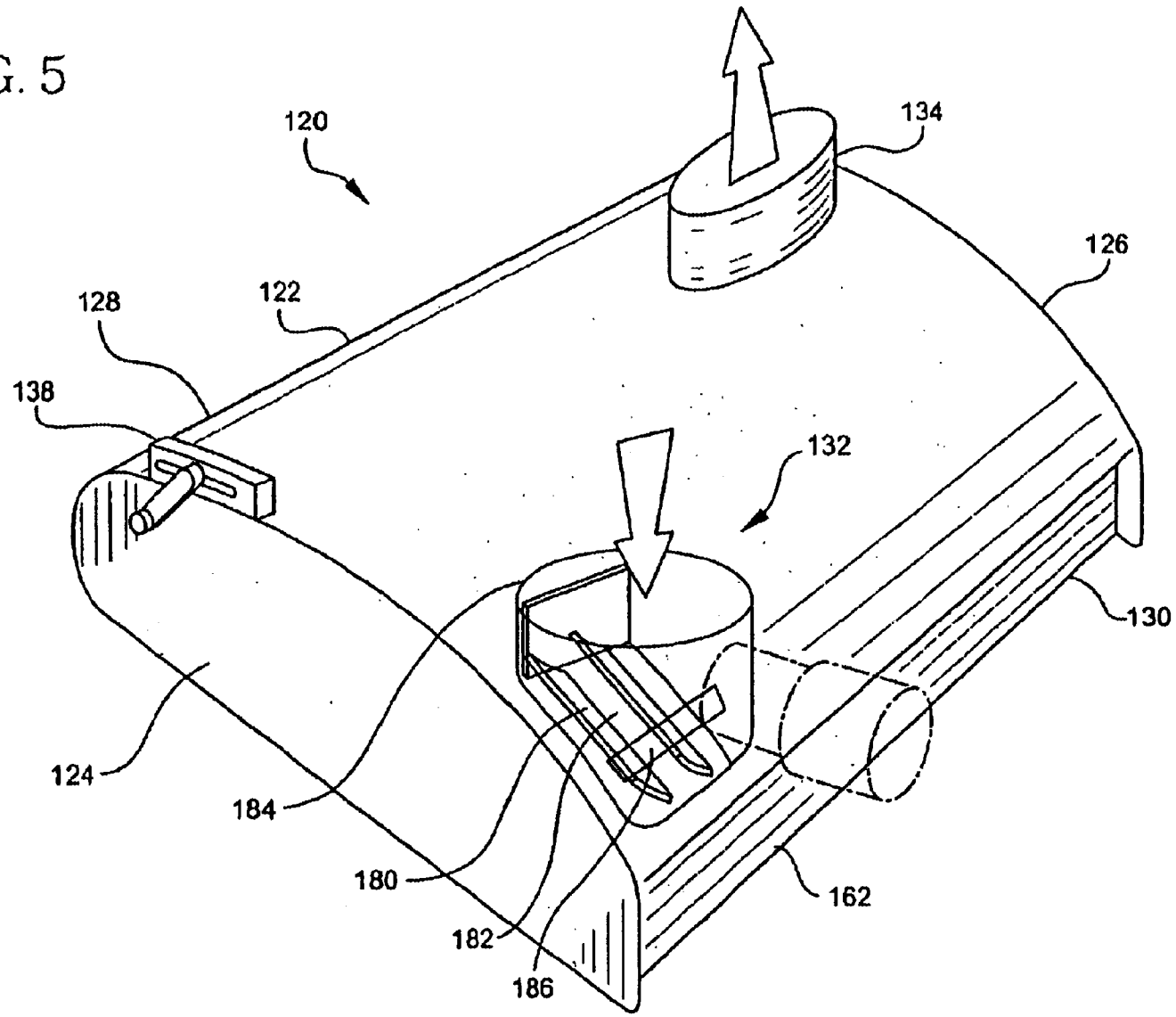
FIG. 5 is a partial perspective view of the exterior surfaces of the head assembly according to the present invention.

Turning to FIG. 5, the head assembly 120 includes an exterior surface 122 a left side 124, a right side 126, a front end 128 and a rear end 130. The head assembly 120 also includes an input portion 132 and an output portion 134 located adjacent the left and right sides 124, 126, respectively. The input portion 132 is in communication with the high pressure conduit 100 of the debris conveyer 80 while the output portion 134 is in communication with low pressure debris conduit 94. The input portion 132 may include an optional bypass 136 which is operatively connected via bypass conduit (not shown) to the third hopper 64. Air flow within the input portion 132 may be improved by transitioning from a circular to a rectangular cross-section and with the provision of internal vanes 180, 182, a web 184 and a diverter 186. In operation, the internal vanes 180, 182 direct a portion of the air stream into the far end of the manifold 164. The web 184 is used to direct a portion of the air stream towards the near end of the manifold 164. And the diverter 186 is used to direct a portion of the air stream towards the optional bypass 136.

As mentioned previously, the output portion 134 is contiguous with and substantially tangent to a predetermined circumferential surface of the main chamber. Preferably, the predetermined surface is a portion of or a portion adjacent to the upper edge of the first front skirt 140. The output portion 134 is generally ovate, and preferably somewhat d-shaped with the longitudinal cross-sectional axis in alignment with the longitudinal axis of the head assembly 120. This arrangement allows long objects such as twigs to be drawn into the output portion 134. The head also includes an actuator 138 which is operatively connected to a first front skirt (see FIGS. 8 and 9).

Figure 6:
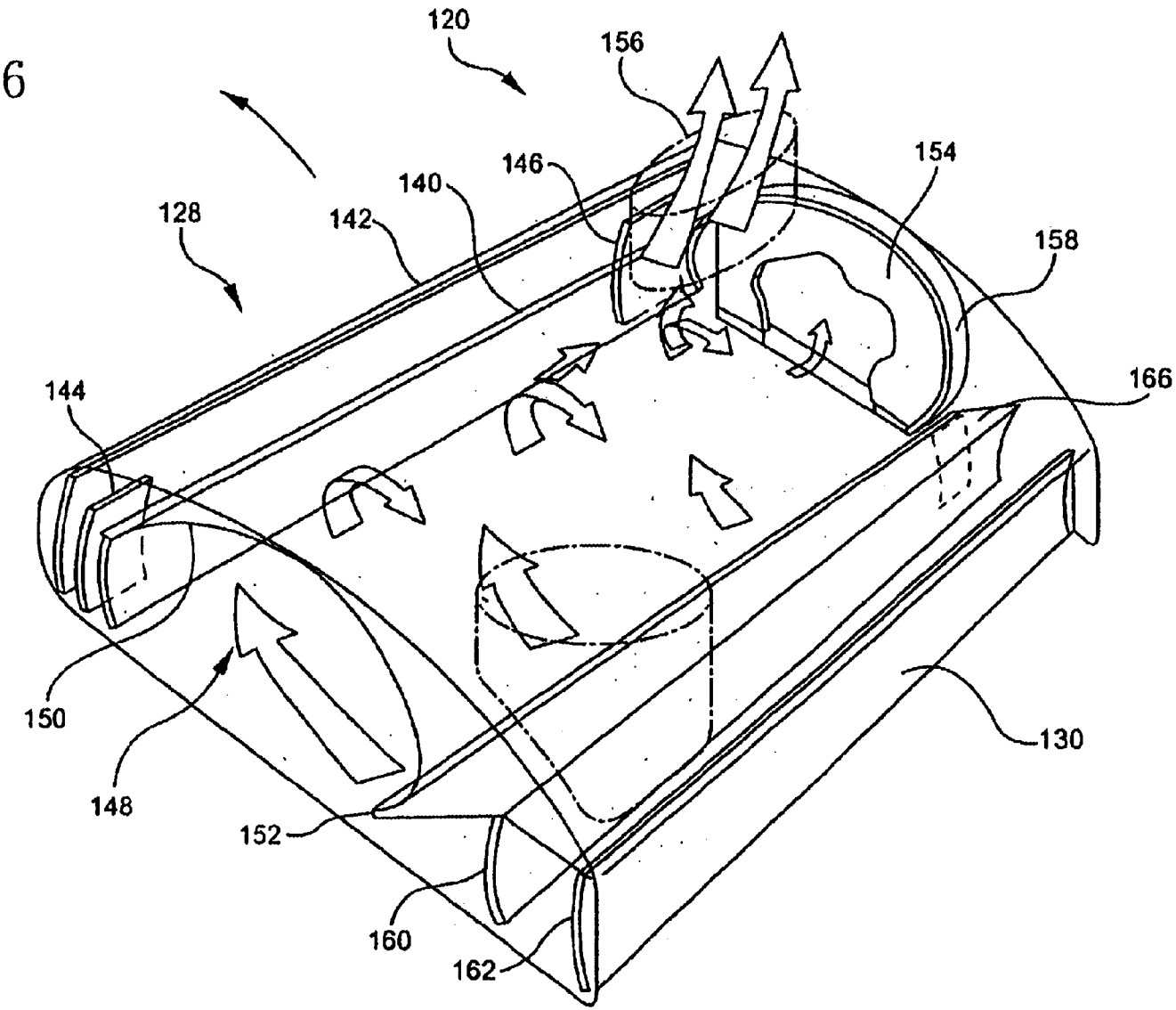
FIG. 6 is a partial segmented perspective view of FIG. 5 illustrating the interior components according to the present invention.
Figure 7:
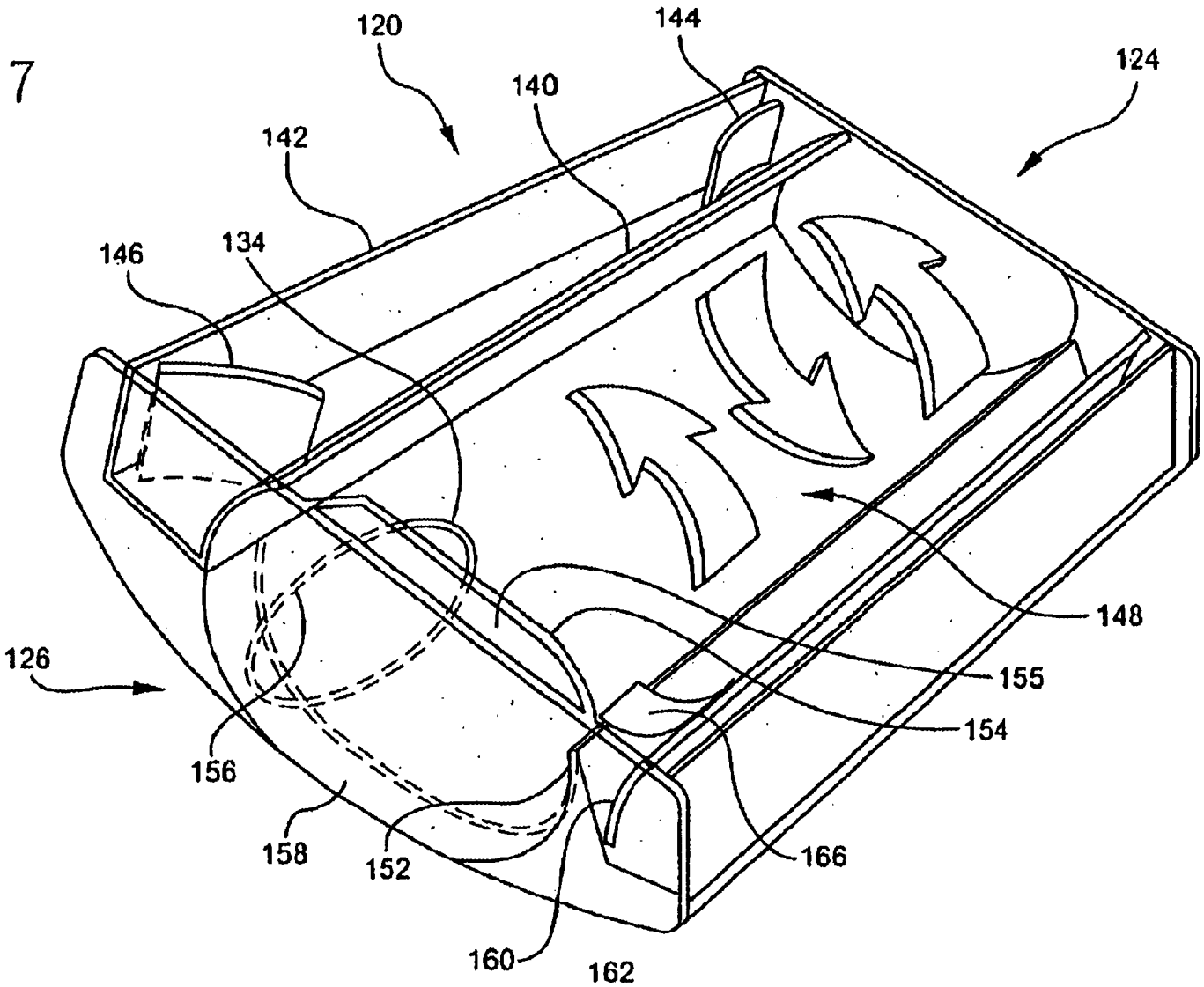
FIG. 7 is a partial segmented perspective inverted view of FIG. 5 illustrating the interior components according to the present invention.

FIGS. 6 and 7 illustrate the interior of the head assembly 120. Starting from the main pick-up chamber 148 and moving towards the front end 128, the head assembly 120 includes a first front skirt 140 and a second front skirt 142, with left and right side skirts 144, 146 positioned therebetween. The first front skirt 140 is adjacent to and substantially parallel to the longitudinal axis of the main chamber 148. Preferably, the first front skirt 140 extends from the interior surface 150 of the main chamber 148 in a streamline fashion. Moving along, there is a second front skirt 142 which is positioned adjacent the first front skirt 140 in substantially parallel relation thereto. A pair of short side skirts 144, 146 are interposed between the first and second front skirt and extend from the head assembly to a surface to be swept. The left side skirt 144 serves several functions. It prevents trailing and dusting at the edge of the first front skirt 140 by creating a relatively high pressure zone in front of the first front skirt 140. As a result of the pressure differential, entrained debris is urged towards the center of the head assembly where it is more easily re-entrained. The right side skirt 146 also urges some debris towards the center of the head assembly 120 as in the left side skirt 144, but its main function is to urge debris towards the center of the head assembly 120 via an angled surface.

Figure 8:
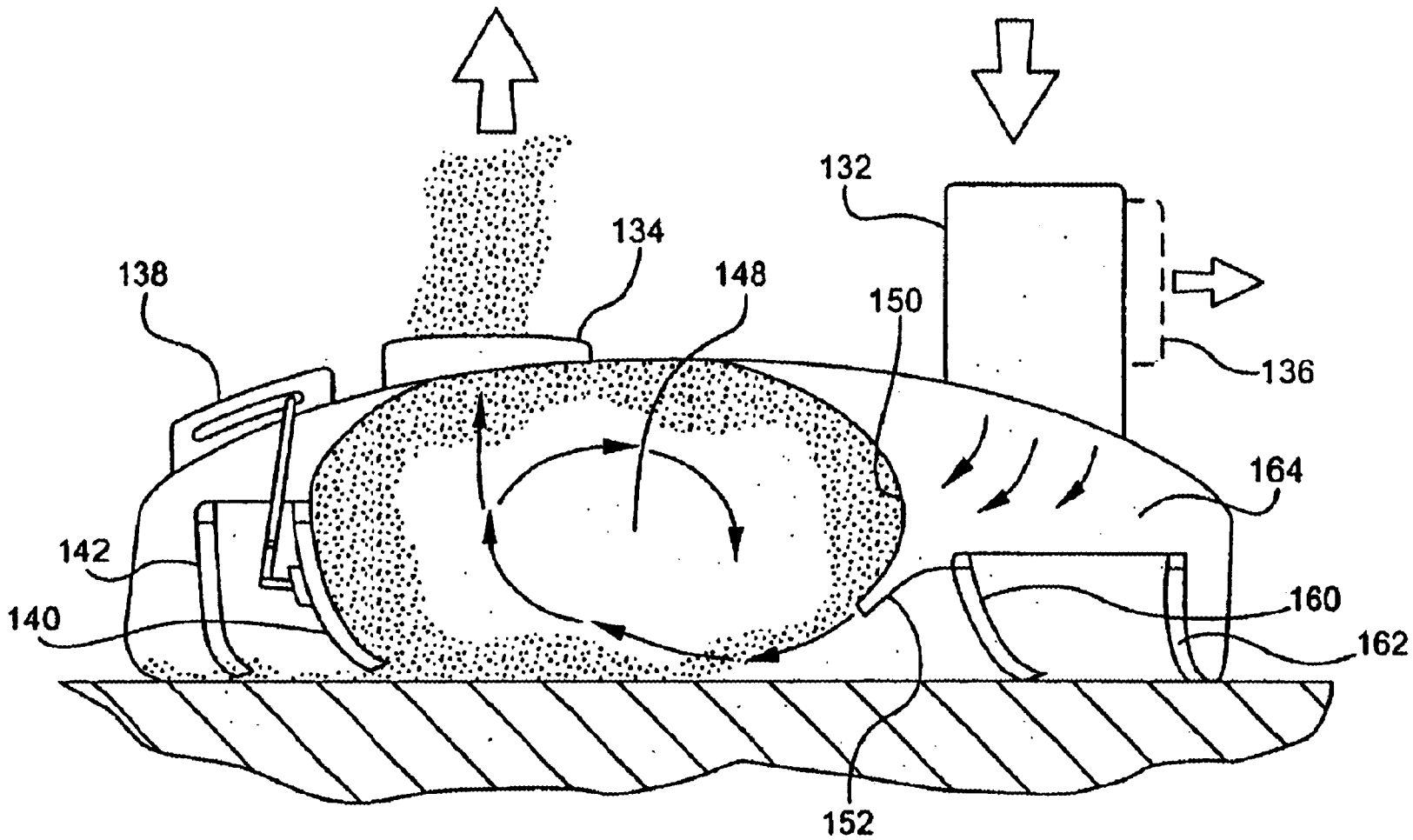
FIG. 8 is a partial, simplified side view of the head assembly of the present invention illustrating operation in a first mode where relatively heavy debris is being removed from a surface; and, FIG. 9 is a partial, simplified side view of the head assembly of the present invention illustrating operation in a second mode where relatively light debris is being removed from a surface.
Figure 9:
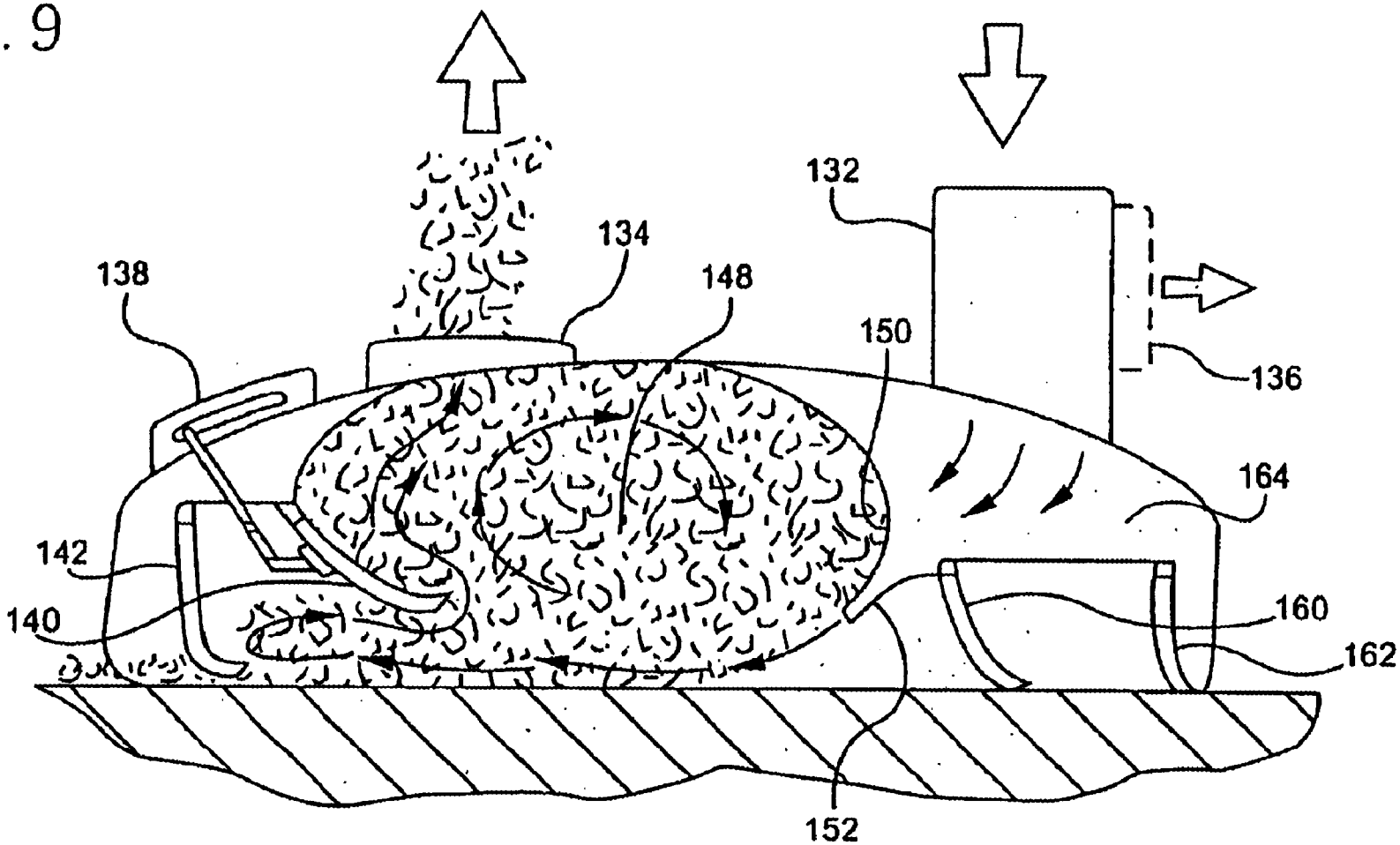

Moving rearwardly, a nozzle 152 is positioned adjacent to and substantially parallel to the longitudinal axis of the main chamber 148, though offset relative to the direction of machine movement. The nozzle 152 extends from the interior surface 150 of the main chamber 148 in a streamline fashion and is arranged to direct a flow of air in a generally downwardly and forwardly direction in a range of around 45–60 degrees relative to the ground. The term nozzle is understood to include a single nozzle such as an air knife or a plurality of nozzles. Preferably, the nozzle 152 is capable of producing a sheet of air as in an air knife. As best shown in FIGS. 8 and 9, pressurized air enters the input portion 132 of the head assembly 120 and is directed towards a manifold 164 which is in communication with the nozzle 152. As the pressurized air exits the nozzle 152 it is directed towards the surface to be swept. As it reaches the first front skirt 140, it is directed upwardly towards the inner surface 150 of the main chamber 148. The air stream then continues along the inner surface 150 in a circular motion to form a vortex. As the vortex moves along a surface to be cleaned or swept, debris is entrained. Preferably, the nozzle 152 and/or the main chamber 148 is/are skewed with respect to the direction of motion of the head assembly 120 as it is drawn along a surface to be cleaned. This enables the entrained debris to be directed towards the output portion 134 of the head assembly 120. Once the debris reaches the output portion 134 exits the main chamber 148 in a generally tangential direction and enters the low pressure conduit 94 which conveys the debris into the debris receptacle 30.

Continuing rearwardly, the head assembly 120 includes a first rear skirt 160 which is positioned adjacent the main chamber in substantially parallel relation thereto and which extends from the head assembly 120 to a surface to be swept. The main function of the first rear skirt 160 is to prevent clouds of dust from exiting the rear of the head assembly 120. It does this by physically capturing entrained debris in a zone of relatively higher pressure then that of the main chamber. Due to the pressure differential, the entrained debris is urged back into the main chamber where it is re-entrained. The odd bit of debris which does not become immediately re-entrained is directed towards the main chamber 148 by a scavenger strip 166 located adjacent the output portion 134 of the head assembly 120. Moving along, the head assembly includes a second rear skirt 162. Preferably, the second rear skirt 162 is substantially parallel to and in spaced relation to the first rear skirt 160. The main function of the second rear skirt 162 is to act as a back-up to the first rear skirt 160 when the first rear skirt 160 is temporarily displaced from a surface being swept. It too, relies on pressure differentials to capture and transport entrained debris back into the main chamber. The skirt material is conventional, with the first front skirt and the two side skirts preferably a three ply elastomeric material having a thickness of around 0.375 inch, while the second front skirt and the two rear skirts are preferably a two ply elastomeric material having a thickness of around 0.0625 inch. It is understood, however, that other materials having similar characteristics may be used.

As debris is entrained and conveyed from the input portion 132 of the head assembly to the output portion 134 of the head assembly it sometimes has enough velocity to enable it to be blown past the end of the head assembly 120 to form dust clouds. The provision of an inner wall or barrier 154 substantially reduces this dusting. The barrier 154 is positioned inwardly of the right side 126 of the head assembly 120 and forms a relatively low pressure recovery chamber 158 therewith. Preferably, the barrier 154 includes a strip 155 of elastomeric material along its bottom edge. The barrier 154 serves to slow or stop debris which impinges thereon. In operation, most of the entrained debris impinges on the barrier 154 and is drawn into the output portion 134 of the head assembly. Any debris that manages to find its way past the barrier, having lost its momentum, is easily re-entrained in the recovery chamber and directed into the output portion 134 of the head assembly. Side dusting is thus reduced. The barrier 154 may include a stop portion 156 which limits the degree to which the first front skirt 140 may be selectively moved. This prevents the first front skirt from being sucked into the output portion 134 of the head assembly.

Operation of the air sweeping apparatus can be best appreciated by viewing FIGS. 8 and 9. When the debris comprises heavy, dense material such as sand and pea gravel, the first front skirt 140 is positioned in a first mode of operation so that it extends toward a surface to be swept. In this mode of operation, the first front skirt 140 the interior surface 150, the nozzle 152 and a surface being swept combine to foster the formation of a vortex or cyclone. This vortex is at a maximum strength and able to entrain debris and drawn them along the longitudinal extent of the main chamber in a helical or spiral manner.

When it is desired to collect lighter material, the operator of the air sweeping apparatus causes the actuator 138 to position the first front skirt 140 in a second mode of operation. In the second mode of operation, the first front skirt 140 is shifted away from a surface to be swept. This creates a gap through which light debris such as empty containers may pass and be collected by the main chamber 148. Note that the air flow is slightly disrupted as it now extends towards the second front skirt 142 and negotiates the upraised first front skirt 140. In spite of the disruption, the general form of the vortex is maintained and the vortex entrains debris and draws them along the longitudinal extent of the main chamber as in the first mode of operation. When the first front skirt 140 is in this second mode of operation, light debris such as empty containers may be collected by the head assembly.

The actuator 138 may be mechanical, electromechanical, hydraulic, pneumatic or similar device capable of shifting or pivoting the first front skirt 140 between selected positions. Preferably, the first front skirt 140 is somewhat rigidly attached to the head assembly 120 and shifted by bending the first front skirt 140 back and forth.

It is understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed:

1. An air sweeping system for removing debris from a surface, the system comprising:

a head assembly having a main chamber for debris pick-tip having an outlet portion; a nozzle configured to direct a flow of sir into the main chamber to entrain debris; a manifold in communication with the nozzle, with one end of the manifold including an input portion to receive pressurized air; a first front skirt, the first front skirt positioned adjacent to and substantially coextensive with the main chamber, the first from skirt selectively movable between a first position and a second position;

a debris receptacle, with a first bin having a low pressure debris conduit port and a second bin in communication with the first bin, the second bin including a separator having an intake aperture, a debris aperture and an exhaust, the first and second bins having adjacent discharge openings which are accessible through a movable panel; and a debris conveyer operatively connecting the head assembly to the debris receptacle;

wherein an air stream with entrained debris is conveyed from the output portion of the head assembly to the debris receptacle, debris separated and conveyed to the input portion of the head assembly.

2. The air sweeping system of claim 1, further comprising a second front skirt, the second front skirt adjacent to and in spaced relation in front of the first front skirt, the second front skirt substantially coextensive with the main chamber and extending from the head assembly to a surface to be swept.

3. The air sweeping system of claim 1, further comprising a first rear skirt, the first rear skirt positioned adjacent to and substantially coextensive with the main chamber, the first rear skirt extending from the head assembly to a surface to be swept.

4. The air sweeping system of claim 1, wherein a portion of the air stream that is conveyed toward the input portion of the head assembly is directed back into the debris receptacle for further filtering and then exhausted to the atmosphere.

5. An air sweeping system for removing debris from a surface, the system comprising:

a head assembly having a main chamber for debris pick-up having a substantially curvilinear interior surface and a longitudinal axis, the main chamber having an outlet portion; a nozzle configured to direct a flow of air into the main chamber to entrain debris; a manifold in communication with the nozzle, with one end of the manifold including an input portion to receive pressurized air; a first front skirt, the first front skirt positioned adjacent to and substantially coextensive with the main chamber, the first front skirt selectively movable between a first position and a second position;

a debris receptacle for receiving debris; and, a debris conveyer operatively connecting the head assembly to the debris receptacle;

wherein an air stream with entrained debris is conveyed from the output portion of the head assembly to the debris receptacle, filtered and conveyed to the input portion of the head assembly.

6. The sweeping system of claim 5, wherein the air flow dissected into the main chamber by the nozzle is generally transverse to the longitudinal axis of the main chamber.

7. The sweeping system of claim 5, wherein the air flow directed into the main chamber is skewed with respect to the direction of motion of the head assembly over a surface being cleaned.

8. The sweeping system of claim 5, wherein the main chamber is skewed with respect to the direction of motion of the head assembly over a surface being cleaned.

9. The sweeping system of claim 5, wherein the debris conveyer includes a debris conduit having a veriable cross-sectional area along at least a portion of its length to diffuse the air stream as it moves therealong.

10. The sweeping system of claim 5, wherein the debris receptacle includes a plurality of bins, with the plurality of bins including a plurality of discharge openings, and wherein the debris receptacle includes a movable panel configured to be positioned in sealing relation to at least one of the plurality of discharge openings.

11. A head assembly for use in conjunction with a debris conveyer and a debris receptacle of an air sweeping apparatus, the head assembly comprising:

a main chamber for debris pick-up having an outlet portion;

a nozzle configured to direct a flow of air into the main chamber;

a manifold in communication with the nozzle, with one end of the manifold including an input portion to receive pressurized air, a first front skirt, the first front skirt positioned adjacent to and substantially coextensive with the main chamber, the first front skirt selectively movable between a first position and a second position;

a second front skirt, the second front skirt adjacent to and in spaced relation in front of the first front skirt the second front skirt substantially coextensive with the main chamber; and a side skirt located between the first and second front skirts, the side skirt movable between a first position and a second position in response to the movement of the first front skirt.

12. The assembly of claim 11, wherein the main chamber has a substantially curvilinear interior surface.

13. The assembly of claim 12, wherein the interior surface is ovate.

14. The assembly of claim 11, the nozzle extends along the main chamber.

15. The assembly of claim 11, wherein the nozzle is an air knife.

16. The assembly of claim 11, wherein the main chamber is skewed with respect to the direction of motion of the head assembly.

17. The assembly of claim 16, wherein the nozzle extends along the main chamber, and wherein the nozzle is substantially parallel in relation thereto.

18. The assembly of claim 11, wherein the nozzle is skewed with respect to the direction of motion of the head assembly.

19. The assembly of claim 11, further including an actuator operatively connected to the first front skirt for selective movement thereof between the first position and the second position.

20. The assembly of claim 11, further comprising a first rear skirt, the first rear skirt positioned adjacent to and substantially coextensive with the main chamber, the first rear skirt extending from the head assembly to a surface to be swept.

21. The assembly of claim 20, further comprising a second rear skirt, the second rear skirt positioned adjacent to and in spaced relation behind the first rear skirt, the second rear skirt substantially coextensive with the main chamber and extending from the head assembly to a surface to be swept.

22. The assembly of claim 21, further comprising side skirts positioned at either side of the head assembly and between the fist and second front skirts.

23. The assembly of claim 11, the main chamber further including a barrier positioned inwardly from one side of the chamber to define a recovery chamber, the recovery chamber in communication with the outlet portion of the head assembly.

24. The assembly of claim 23, the barrier further including a stop for limiting the movement of the first front skirt.

25. The assembly of claim 11, wherein the first front skirt is flexible.

26. The assembly of claim 11, wherein the first front skirt is in substantially parallel relation with the main chamber.

27. The assembly of claim 26, wherein the second front skirt is in substantially parallel relation with the main chamber.

28. A debris receptacle for use in conjunction with a debris conveyor in an air sweeping apparatus, the receptacle comprising:

a plurality of wall portions defining a substantially closed chamber;

a movable panel, the movable panel configured to be positioned in sealing relation to the chamber; and a first partition end a second partition, the partitions defining a first bin, a second bin, and a third bin, the first bin having a debris inlet port, the second bin in communication with the first bin, the second bin including a separator having an intake aperture, a debris aperture and an exhaust, the exhaust in communication with a debris conveyer, the third bin including a bypass port for receiving an air stream from a bypass conduit.

29. The debris receptacle of claim 28, wherein the separator is a centrifugal separator.

30. The debris receptacle of claim 29, wherein the centrifugal separator includes at exhaust air stream which is coupled via an extension element to a low pressure end of the debris conveyer, and wherein the extension element includes an aperture providing air communication between the exhaust air stream and the second bin.

31. The debris receptacle of claim 28, wherein the first, second and third bins include discharge openings which are adjacent to each other and accessible through the movable panel.

32. The debris receptacle of claim 28, further comprising a first filter element operatively positioned between the first and second bins and configured to prevent debris larger than a first predetermined size from entering the second bin.

33. The debris receptacle of claim 32, further comprising a second filter element operatively positioned adjacent to a section of the third bin and configured to prevent debris larger than a second predetermined size front being exhausted into the atmosphere.

34. A debris receptacle for use in conjunction with a debris conveyor in an air sweeping apparatus, the receptacle comprising:

a first bin having a low pressure debris conduit port and a second bin in communication with the first bin, the second bin including a separator having an intake aperture, a debris aperture and an exhaust, the exhaust in communication with a debris conveyer, with the first and second bins having adjacent discharge openings which are accessible through a movable panel.

35. The debris receptacle of claim 34, wherein the discharge openings of the first and second bins are substantially coplanar.

36. A debris receptacle of claim 34, further comprising:

a third bin having a bypass port for receiving an air stream from a bypass conduit and a discharge opening, with the discharge opening adjacent the discharge openings of the first and second bins; wherein the first, second and third discharge openings are accessible through the movable panel.

37. The debris receptacle of claim 36, wherein the discharge openings of the first, second third bins are substantially coplanar.

38. A method for removing and collecting debris from a generally horizontal surface, the method comprising the steps of:

forming an air stream into a substantially horizontally aligned vortex;

entraining debris within the vortex by drawing the vortex thereover;

conveying the debris from the vortex to a first bin;

removing in the first bin a debris larger than a first predetermined size from the air stream;

convoying the air stream into a second bin;

separating in the second bin some of the remaining debris front the air stream; and conveying the air stream back to the vortex.

39. The method of claim 38, wherein the step of conveying the debris from the vortex to the first bin includes the step of diffusing the air stream.

40. The method of claim, 38, wherein the step of removing debris larger than a first predetermined size from the air stream includes the step of:

directing the air strew through a first filter element.

41. The method of claim 38, further including the step of:

directing a portion of the air stream being conveyed back to the vortex into a third bin.

42. The method of claim 41, further including the steps of:

removing in the third bin debris larger than a second predetermined size from air stream; and, exhausting an air stream from the third bin into the atmosphere.

43. The method of claim 42, wherein the step of removing debris larger than a second predetermined size from the air stream includes the step of:

directing the air stream through a second filter element.

44. A head assembly for use in conjunction with a debris conveyer and a debris receptacle of an air sweeping apparatus, the head assembly comprising:

a main chamber for debris pick-up having a front end, a rear end, opposing sides, an input portion and an outlet portion, the main chamber having a substantially curvilinear interior surface and a longitudinal axis;

a nozzle, the nozzle operatively connected to the input portion and configured to direct a flow of air into the main chamber;

a first front skirt positioned adjacent to and substantially coextensive with the front end of the main debris pick-up chamber, the first front skirt selectively movable between a first position and a second position;

a first rear skirt positioned adjacent to and substantially coextensive with the rear end of the main debris pick-up chamber; and, a barrier, the barrier positioned adjacent to and inwardly with respect to one of the sides of the main debris pick-up chamber, the barrier and the one side of the main debris chamber forming a recovery chamber; wherein, the barrier and the recovery chamber operate in concert to direct entrained debris into the output portion of the main debris pick-up chamber to reduce dusting and trailing.

45. The assembly of claim 44, wherein the main debris pick-up chamber has a cross-sectional area, and wherein the barrier is substantially the same size as the said cross-sectional area.

46. A head assembly for use in conjunction with a debris conveyer and a debris receptacle of an air sweeping apparatus, the head assembly comprising:

a main chamber for debris pick-up having a front end, a rear end, opposing sides, an input portion and an outlet portion, the main chamber having a substantially curvilinear interior surface and a longitudinal axis;

a nozzle, the nozzle operatively connected to the input portion and configured to direct a flow of air into the main chamber;

a first front skirt positioned adjacent to and substantially coextensive with the front end of the main debris pick-up chamber, the first front skirt selectively movable between a first position and a second position;

a first rear skirt positioned adjacent to and substantially coextensive with the rear end of the main debris pick-up chamber; and, a scavenger strip positioned adjacent to and extending forwardly from the first rear skirt; wherein, the scavenger strip directs entrained debris towards the main debris pick-up chamber to reduce trailing and dusting.

* * * * *

UNITED STATES PATENT AND TRADEMARK OFFICE

CERTIFICATE OF CORRECTION

PATENT NO. : 6,742,219 B2
DATED : June 1, 2004
INVENTOR(S) : Lenzmeier, Michael H. et al.

It is certified that error appears in the above-identified patent and that said Letters Patent is hereby corrected as shown below:

Column 10,
Line 34, delete “pick-tip” and insert -- pick-up --.
Line 35, delete “sir” and insert -- air --.
Line 40, delete “from” and insert -- front --.

Column 11,
Line 27, delete “dissected” and insert -- directed --.
Line 37, delete “veriable” and insert -- variable --.
Line 55, delete “,” and insert -- ; --.
Line 62, insert -- , -- between “skirt” and “the”.

Column 11, line 65 through Column 12, line 2,
Delete “, the side skirt movable between a first position and a second position in response to the movement of the first front skirt”.

Column 13,
Line 4, delete “at” and insert -- an --.
Line 20, delete “front” and insert -- from --.
Line 43, insert -- and -- between “second” and “third”.
Line 55, delete “convoying” and insert -- conveying --.
Line 57, delete “front” and insert -- from --.
Line 61, delete the “,” between “claim” and “38”.
Line 65, delete “strew” and insert -- stream --.

Signed and Sealed this

Fourth Day of October, 2005

JON W. DUDAS
*Director of the United States Patent and Trademark Office*